US006915787B2

(12) United States Patent
Yoshioka et al.

(10) Patent No.: US 6,915,787 B2
(45) Date of Patent: Jul. 12, 2005

(54) FUEL SUPPLY APPARATUS AND FUEL PRESSURE REGULATOR

(75) Inventors: Hiroshi Yoshioka, Chiyoda-ku (JP); Hisashi Kuwada, Chiyoda-ku (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/493,579

(22) PCT Filed: May 29, 2002

(86) PCT No.: PCT/JP02/05212

§ 371 (c)(1),
(2), (4) Date: Oct. 20, 2004

(87) PCT Pub. No.: WO03/100246

PCT Pub. Date: Dec. 4, 2003

(65) Prior Publication Data

US 2005/0056257 A1 Mar. 17, 2005

(51) Int. Cl.[7] ..... F02M 37/00; F02M 37/10

(52) U.S. Cl. ..... 123/457; 123/506; 123/514; 137/601.2; 137/491; 137/512

(58) Field of Search ..... 123/446, 457, 123/459, 506, 510, 511, 514; 137/629, 601.2, 491, 489.3, 492.5, 512.1, 512

(56) References Cited

U.S. PATENT DOCUMENTS 3,604,446 A * 9/1971 Brooks ..... 137/115.03
5,649,514 A * 7/1997 Okada et al. ..... 123/514
5,762,047 A 6/1998 Yoshioka et al.
6,125,822 A * 10/2000 Janik et al. ..... 123/457
6,446,613 B1 * 9/2002 Djordjevic ..... 123/514
6,520,163 B2 * 2/2003 Yoshioka et al. ..... 123/510
6,786,231 B2 * 9/2004 Buescher et al. ..... 137/491

FOREIGN PATENT DOCUMENTS

| | | |
|---|---|---|
| JP | 2-85864 U | 7/1990 |
| JP | 08-232790 A | 9/1996 |
| JP | 10-89183 A | 4/1998 |
| WO | WO 96/23967 | 8/1996 |

* cited by examiner

*Primary Examiner*—Weilun Lo
(74) *Attorney, Agent, or Firm*—Sughrue Mion, PLLC

(57) ABSTRACT

A fuel supply apparatus having a fuel pressure regulator (60) for regulating the pressure of fuel discharged from a fuel pump (4) to a predetermined pressure, the fuel pressure regulator (60) including: a first chamber (62), formed in a case (61), into which fuel discharged from the fuel pump (4) flows, and a second chamber (63), into which the fuel flows via the first chamber (62); a fuel limiting means (64) disposed between the first chamber (62) and the second chamber (63), for limiting fuel flowing from the first chamber (62) into the second chamber (63); a pilot valve unit (65) having a passageway for opening to discharge fuel tank (2), when the fuel pressure in the second chamber (63) is more than a first set pressure (Pp); and a main valve unit (66) having a passageway for opening to discharge fuel into the fuel tank (2) when the fuel pressure in the first chamber (62) is equal to a second set pressure (Pm) between the first set pressure (Pp) and the predetermined pressure (Pi), whereby, in cases where returning flow volume drops, the pressure of the fuel delivered under pressure to the injector does not drop.

6 Claims, 5 Drawing Sheets

FUEL SUPPLY APPARATUS AND FUEL PRESSURE REGULATOR

TECHNICAL FIELD

The present invention relates to a fuel supply apparatus that is fitted inside a fuel tank in a vehicle, etc., for pressurizing and supplying fuel to an injector that injects fuel into the engine, and the invention also relates to a fuel pressure regulator for regulating fuel pressure to a predetermined value.

BACKGROUND ART

FIG. 4 is a sectional side view of a conventional fuel supply apparatus disclosed in Int'l. Pat. App. Pub. No. WO96-23967.

In the figure, a fuel supply apparatus 1 integrally comprises a cover 3, a fuel pump 4, a fuel filter 5, a fuel pressure regulator 6, a discharge pipe 7, and a fuel level gauge and an electrical connector that are not illustrated in the figure, and the apparatus is suspended from an opening 2*a* of a fuel tank 2 formed of metal or resin.

The fuel filter 5 comprises a holding member 5*a*, formed of electrically conductive resin and a filter element, 5*b* contained therein, and is welded, liquid-tight, at its boundary portion 8 to the cover 3. The holding member 5*a* in its center portion holds the fuel pump 4, and at its lower end holds the fuel pressure regulator 6 and the fuel level gauge which is not illustrated. A gasket 9 is interposed to maintain an airtight seal between the cover 3 and the fuel tank 2.

In the holding member 5*a* of the fuel filter 5, an inlet 10 as a fuel inlet for the fuel filter 5 is provided in the upper inside periphery of the holding member 5*a*, and is connected via a sealing member 10*a* to a discharge pipe 11 of the fuel pump 4.

Moreover, the holding member 5*a* of the fuel filter 5 has two fuel outlets. A channel 12 (indicated by the dotted-dashed line), which forms the first fuel outlet, extends from the lower end of the holding member 5*a* axially in an upward direction. The channel 12 connects with the discharge pipe 7 provided on the cover 3 and supplies fuel, that has been filtered, to an injector. A return path 13, forming the second fuel outlet, is provided in the lower portion of the holding member 5*a*, and is connected to the fuel pressure regulator 6.

Reference numeral 14 is a pump filter, and when the fuel in the fuel tank 2 is drawn into the fuel pump 4, the pump filter 14 filters out foreign particles from the fuel tank 2, such as iron powder, etc.

The fuel pressure regulator 6 is fixed by inserting a base 6*a* into an insertion member 5*c* that extends downward from the bottom portion of the holding member 5*a*. A diaphragm 6*c* is interposed between an opening end of the base 6*a* and a housing 6*b*, and the diaphragm 6*c* is supported by a movable valve seat 6*e* provided with a discharge orifice 6*d*.

A stationary valve seat 6*f* that co-functions with the movable valve seat 6*e* is fixed inside the base 6*a*. A spring 6*g* is contained between the housing 6*b* and the diaphragm 6*c*, and, at the lower portion of the housing 6*b*, a discharge outlet 6*h* is disposed to discharge the fuel from the discharge orifice 6*d* into the fuel tank 2.

Reference numeral 4*a* is an electric current supply unit for supplying current to a motor, not illustrated, for the fuel pump 4, and the electric current supply unit 4*a* is connected electrically to the electrical connector, not illustrated, which is formed integrally with the cover 3.

In the fuel supply apparatus 1 configured in this way, electric current is supplied from a power supply, such as a storage battery, etc., not illustrated, via the electric current supply unit 4*a*, to the motor, not illustrated, of the fuel pump 4. When the motor runs, the fuel in the fuel tank 2 is taken in through the pump filter 14, and after being discharged from the discharge pipe 11, it flows through a channel 15 in the direction of arrow A, then passes through the filter element 5*b*, and arrives at a lower space 16 under the filer element 5*b*.

Next, the fuel flows into the fuel pressure regulator 6, and when fuel pressure in the base 6*a* becomes higher than the set pressure of the spring 6*g*, the diaphragm 6*c* moves to the housing 6*b* side, opening the discharge orifice 6*d* of the movable valve seat 6*e* and discharging the fuel in the base 6*a* to the fuel tank 2 again (returning flow volume) via the discharge outlet 6*h*, and the remaining volume flows through the channel 12 in the direction of arrow B and is supplied at a predetermined pressure through the discharge pipe 7 to the injector, in a fuel injection device mounted on an engine, which is not illustrated.

FIG. 5 is a pressure characteristic diagram of the conventional fuel supply apparatus, illustrating the relation between the returning flow volume (Q) discharged from the fuel pressure regulator 6 to the fuel tank 2, and the fuel pressure (P) of the fuel supplied to the injector. When the returning flow volume (Q) is over Qm, the conventional fuel supply apparatus 1, configured as described above, ensures that the pressure of the fuel delivered under pressure to the injector is above a predetermined pressure Pi, and supplies the fuel to the injector of the fuel injection apparatus attached to the engine.

However, for example, if the voltage supplied to the fuel pump 4 drops abruptly and the discharging performance of the fuel pump 4 deteriorates, or if the fuel that is supplied to the engine abruptly increases, the returning flow volume drops (shifts to the left in the diagram), and thus the problem has occurred that the fuel delivered under pressure to the injector cannot be ensured at the predetermined pressure Pi, and the injector cannot inject the fuel required by the engine.

The present invention is made to solve the above-described problems, and it has as an object the provision of a fuel supply apparatus in which, if the returning flow volume (Q) drops, the pressure of the fuel delivered under pressure to the injector does not drop.

DISCLOSURE OF THE INVENTION

A fuel supply apparatus related to the present invention comprises: a cover fitted to an opening of a fuel tank, and on which a discharge pipe is disposed; a fuel pump for delivering under pressure fuel from the fuel tank to an injector of an engine via the discharge pipe; a fuel filter for filtering the fuel discharged from the fuel pump; and a fuel pressure regulator for regulating the pressure of the fuel discharged from the fuel pump to a predetermined pressure; wherein the fuel pressure regulator includes: a first chamber, formed in a case, into which fuel discharged from the fuel pump flows, and a second chamber, into which the fuel flows via the first chamber; a fuel limiting means disposed between the first chamber and the second chamber, for limiting fuel flowing from the first chamber into the second chamber; a pilot valve unit having a passageway for opening to discharge fuel into the fuel tank when the fuel pressure in the second chamber is more than a first set pressure; and a main valve unit having a passageway for opening to discharge fuel into the fuel tank when the fuel pressure in the first chamber is equal to a second set pressure between the first set pressure and the predetermined pressure.

In this way, in cases where returning flow volume drops, the pressure of the fuel delivered under pressure to the injector does not drop.

Preferably, the main valve unit comprises: a first valve for opening and closing a first communicating hole connecting the first chamber with the fuel tank, and a first elastic member for pressing on the first valve, wherein the first valve is held such that it can slide on a slide portion of the case, and a fuel control means is realized by a gap formed between the slide portion and the first valve.

In this way, the first valve slides smoothly, and the fuel control means can be formed by a simple structure.

Preferably, a diffusing member is installed for dispersal of fuel being returned from the main valve unit to the fuel tank.

In this way, since the fuel discharged from the main valve unit is not injected at high pressure into the fuel tank and components of the fuel supply apparatus, abnormal noise due to fuel collision is not generated.

Preferably, a pore is situated in the first valve.

In this way, control of the fuel flowing from the first chamber into the second chamber is easy and pressure characteristics of the fuel supply apparatus can be set to desired characteristics.

A fuel pressure regulator, in another aspect of the present invention, comprises: a first chamber formed in the case, into which fuel discharged from the fuel pump flows, and a second chamber, into which the fuel flows via the first chamber; a fuel limiting means disposed between the first chamber and the second chamber, for limiting fuel flowing from the first chamber into the second chamber; a first communicating hole for connecting the first chamber with the exterior of the case; a second communicating hole for connecting the second chamber with the exterior of the case; a pilot valve unit for opening to discharge through the second communicating hole, fuel to the exterior of the case when the fuel pressure in the second chamber is more than the first set pressure; and a main valve unit for opening and closing to discharge, through the first communicating hole, fuel to the exterior of the case when the fuel pressure of the first chamber is equal to the second set pressure between the first set pressure and the predetermined pressure.

In this way, based on the pressure characteristics of the fuel pressure regulator, in cases where the returning flow volume drops, the fuel pressure does not drop.

Preferably, a diffusing member is installed for dispersal of fuel discharged from the main valve unit to the exterior of the case.

In this way, since the fuel discharged from the main valve unit is not injected at high pressure, abnormal noise due to the fuel collision is not generated.

BEST MODE FOR CARRYING OUT THE INVENTION

Figure 1:
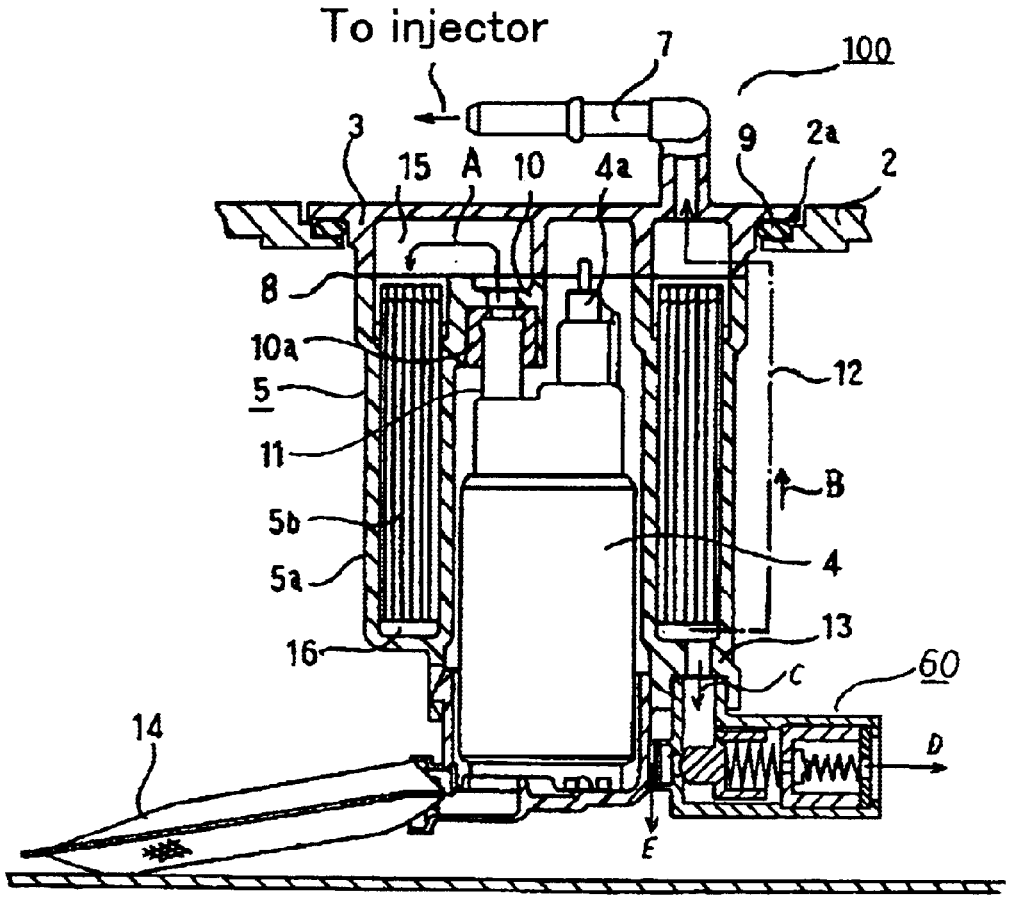
FIG. 1 is a sectional side view of a fuel supply apparatus in an embodiment of the present invention.

FIG. 1 is a sectional side view of a fuel supply apparatus in an embodiment of the present invention. In the figure, the fuel supply apparatus 100 integrally comprises a cover 3, a fuel pump 4, a fuel filter 5, a discharge pipe 7, a pump filter 14, a fuel pressure regulator 60, and a fuel level gauge (not illustrated), and the apparatus is suspended from an opening 2*a* of a fuel tank 2 formed of metal or resin.

The fuel filter 5 comprises a holding member 5*a* formed of electrically conductive resin and a filter element 5*b* contained therein, and is welded, liquid-tight, at its boundary portion 8 to the cover 3. The holding member 5*a* in its center portion holds the fuel pump 4, and at its lower end holds the fuel level gauge (not illustrated). A gasket 9 is interposed to maintain an airtight seal between the cover 3 and the fuel tank 2.

In the holding member 5*a* of the fuel filter 5, an inlet 10 as a fuel inlet for the fuel filter 5 is provided in the upper inside periphery of the holding member 5*a*, and is connected via a sealing member 10*a* to a discharge pipe 11 of the fuel pump 4. A channel 12 (indicated by a dotted-dashed line), which forms the fuel outlet of the fuel filter 5, is disposed in the holding-member 5*a*, and extends from the lower end of the holding member 5*a* axially in an upward direction.

The channel 12 communicates with the discharge pipe 7 provided in the cover 3 and supplies fuel, which has been filtered, to an injector. The fuel pressure regulator 60, which is disposed on the cover 3 outer surface where it is over a passageway (hereinafter fuel pipe) through which the fuel from the channel 12 flows via the discharge pipe 7 to the injector, detects the fuel pressure. Reference numeral 14 is a pump filter that filters out foreign particles, such as iron powder, etc., when the fuel in the fuel tank 2 is drawn into the fuel pump 4.

Figure 2:
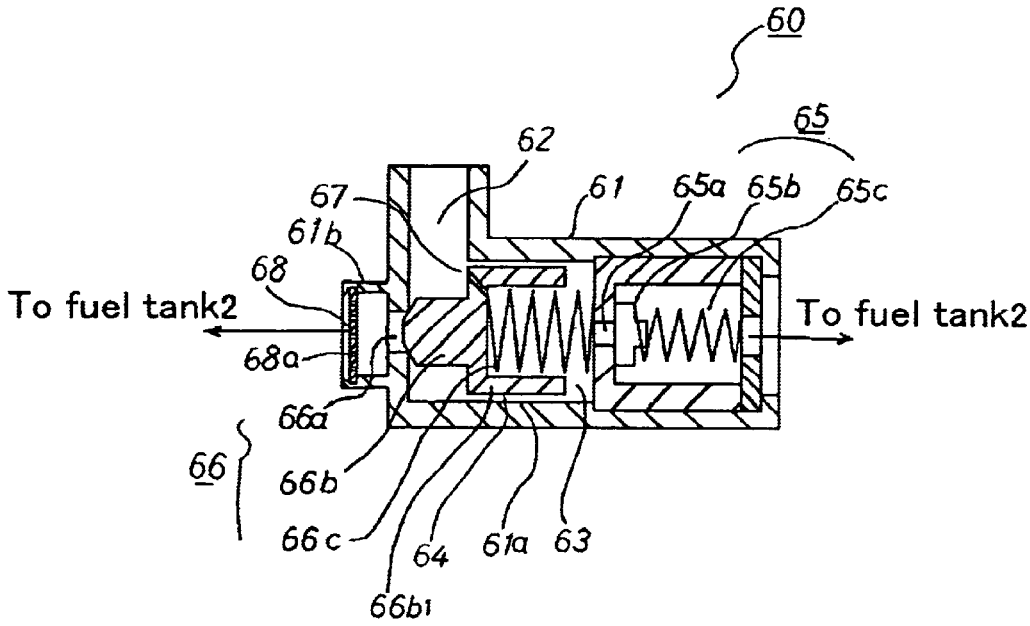
FIG. 2 is an enlarged sectional side view of a fuel pressure regulator in FIG. 1.
Figure 3:
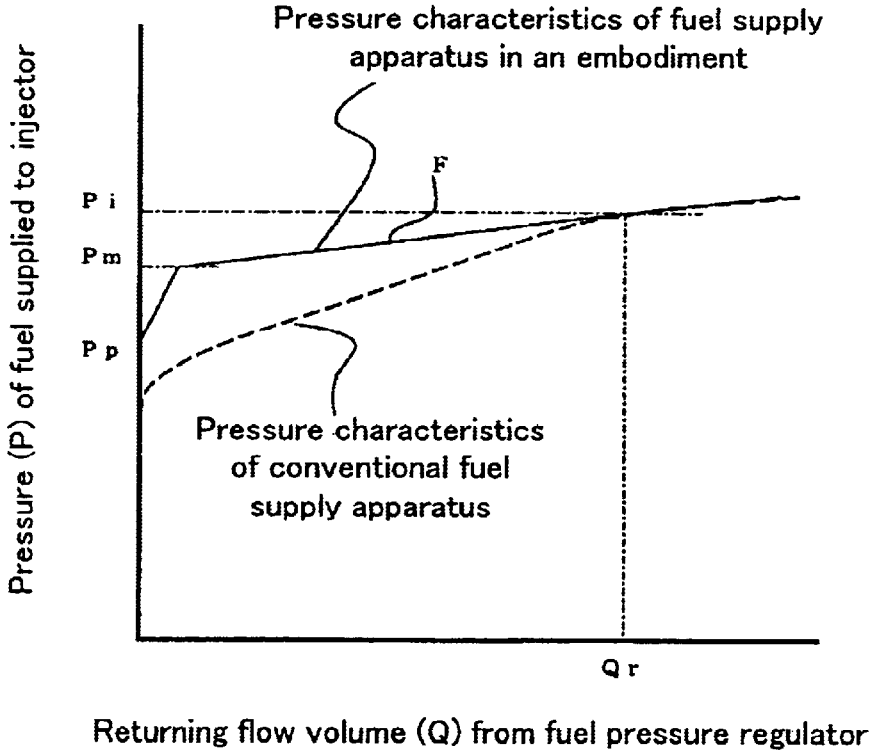
FIG. 3 is a pressure characteristic diagram for the fuel supply apparatus in an embodiment of the present invention.
Figure 4:
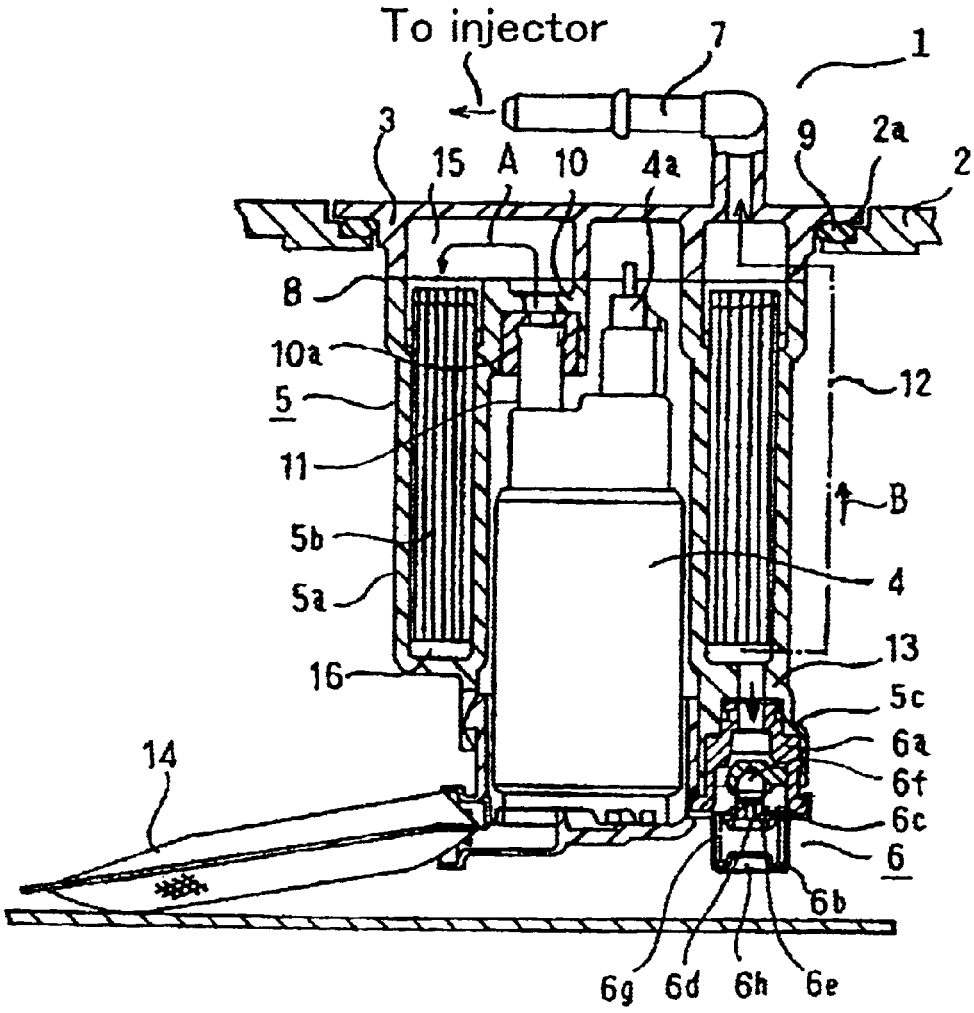
FIG.4 PRIOR ART
FIG. 4 is a sectional side view of a conventional fuel supply apparatus.
Figure 5:
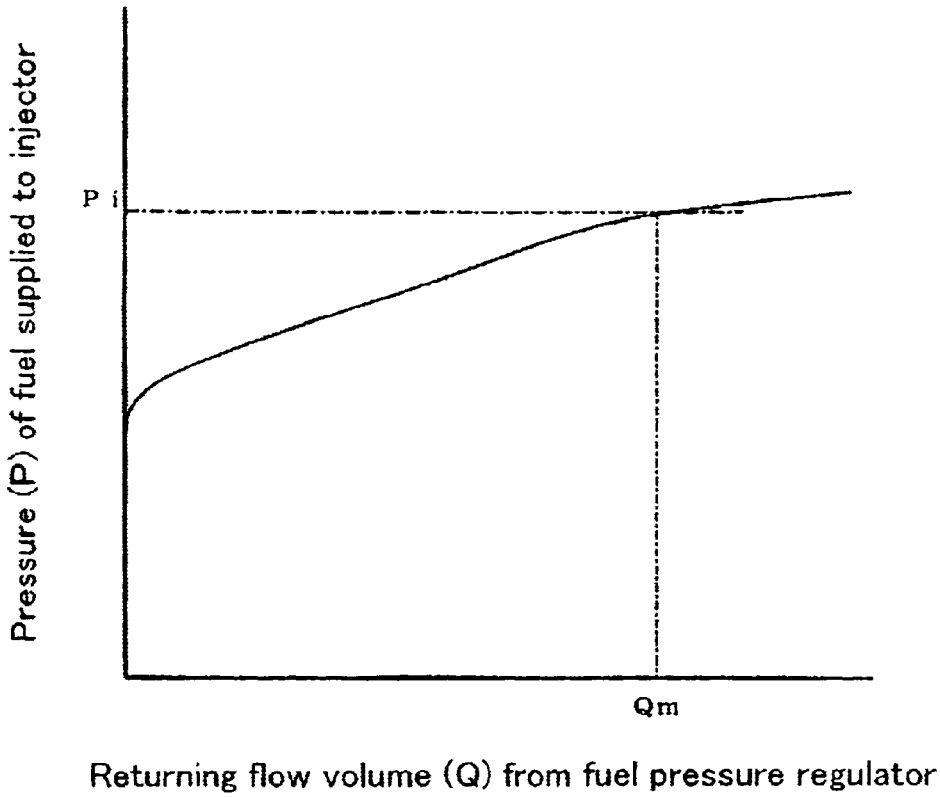
FIG.5 PRIOR ART
FIG. 5 is a pressure characteristic diagram for the conventional fuel supply apparatus.

FIG. 2 is an enlarged sectional side view of the fuel pressure regulator of FIG. 1, and FIG. 3 is a diagram of pressure characteristics of the fuel supply apparatus in an embodiment of the present invention.

In this figure, the fuel pressure regulator 60 comprises a first chamber 62 formed in a case 61, into which the fuel discharged from the fuel pump 4 flows, and a second chamber 63, into which the fuel flows via the first chamber 62; a pilot valve unit 65 that, when the fuel pressure of the second chamber 63 is more than a first set pressure Pp (indicated in FIG. 3), opens its passageway and discharges the fuel into the fuel tank 2; and a main valve unit 66 that, when the fuel pressure of the first chamber 62 reaches a second set pressure Pm (indicated in FIG. 3) between the first set pressure Pp (indicated in FIG. 3) and a predetermined pressure Pi (indicated in FIG. 3), opens its passageway and discharges the fuel into the fuel tank 2.

The main valve unit 66 comprises a first valve 66*b* that opens and closes a first communicating hole 66*a* which connects the first chamber 62 with the fuel tank 2, and a first elastic member 66*c* that presses on the first valve 66*b*. A cylindrical portion 66*b*1 of the first valve 66*b* is held such that it can slide on a slide portion 61*a* of the case 61, and a gap 64 as fuel control means is formed between the cylindrical portion 66*b*1 and the slide portion 61*a*, wherein the fuel flowing from the first chamber 62 into the second chamber 63 is limited by the gap 64.

The pilot valve unit 65 comprises a second valve 65*b* that opens and closes a second communicating hole 65*a*, which connects the second chamber 63 with the fuel tank 2, and a second elastic member 65*c* that presses on the second valve 65*b*.

Reference numeral 67 is a pore having a predetermined cross sectional area, situated in the first valve 66*b* and forming a fuel control means similar to the gap 64; it limits the fuel flowing from the first chamber 62 into the second chamber 63, whereby the pressure characteristics for the fuel supply apparatus shown in FIG. 3 are determined. It should be understood that the pore 67 is furnished as may be necessary; the fuel control means may be formed by the gap 64 only.

Reference numeral 68 is a diffusing member which is formed, for example, by a disk or disks having a plurality of holes, and is firmly fixed to a boss portion 61*b* of the case 61; the fuel discharged from the first communicating hole 66*a* to the fuel tank 2 is diffused through a plurality of percolating holes 68*a*, so that generation of abnormal noise, which accompanies high pressure injection of fuel to the fuel supply apparatus 100 and the fuel tank 2, is prevented.

Next, using FIG. 1 to FIG. 3, operation of the fuel supply apparatus 100 configured in this way is explained.

A current is supplied to a motor (not illustrated) of the fuel pump 4 via an electric current supply unit 4*a* from an electric power source, such as a storage battery (not illustrated); when the motor rotates, the fuel pump 4 activates; after the fuel in the fuel tank 2 is drawn in through the pump filter 14, it is discharged from the discharge pipe 11, flows along a passageway 15 in the direction of arrow A (illustrated in FIG. 1), and after passing the filter element 5*b*, the fuel arrives at a lower space 16 under the filter element 5*b*, and in addition it flows along the channel 12 in the direction of arrow B, passing through the discharge pipe 7, and is supplied to the injector of a fuel injection apparatus fitted to an engine (not illustrated).

Regarding the fuel delivery process, the fuel flows in the direction of arrow B and also flows in the direction of arrow C, and after flowing into the first chamber 62 of the fuel pressure regulator 60, it passes through the gap 64 as well as the pore 67, which are the fuel control means, and flows into the second chamber 63.

As the returning flow volume (Q) increases, when the fuel pressure of the second chamber 63 reaches the first set pressure Pp (indicated in FIG. 3), the second valve 65*b* moves in the right direction in FIG. 2 against the biasing force of the second elastic member 65*c*, thereby opening the passageway, and the fuel in the second chamber 63 flows in the direction of arrow D (illustrated in FIG. 1) and starts to discharge into the fuel tank 2.

Moreover, as the returning flow volume increases, when the fuel pressure of the first chamber 62 reaches the second set pressure Pm between the first set pressure Pp (indicated in FIG. 3) and the predetermined pressure Pi, due to the pressure differential between the fuel pressure of the first chamber 62 and the second chamber 63, the first valve 66*b* opposes the biasing force of the first elastic member 66*c*, whereby the cylindrical portion 66*b*1 slides along the slide portion 61*a* of the case 61, and moves in the right direction in FIG. 2, opening its passageway, and the fuel of the first chamber 62 flows in the direction of arrow E (illustrated in FIG. 1) and discharges to the fuel tank 2.

Moreover, when the returning volume increases and reaches Qr (indicated in FIG. 3), the cylindrical portion 66*b*1 moves along the slide portion 61*a* of the case 61, increasing the fuel flowing in the direction of arrow E, whereby the fuel pressure of the first chamber 62 is regulated to the predetermined pressure Pi.

In this state, in which the fuel pressure of the first chamber 62 is regulated to the predetermined pressure Pi, the injector of the fuel injection apparatus fitted to the engine (not illustrated), is stably supplied with the fuel.

Here, if the voltage supplying the fuel pump 4 drops abruptly and the discharge performance of the fuel pump 4 deteriorates, or if the fuel supplying the engine increases abruptly, the return flow volume decreases (moves to left in FIG. 3), and with the flow volume decrease, the fuel pressure for supplying the injector drops, but because the gradient of the dropping pressure is low (indicated by F in FIG. 3), the fuel is stably supplied to the injector of the fuel injection apparatus fitted to the engine.

Moreover, gradient F of the dropping pressure is dependent on cross sectional area, length and shape of the gap 64 and the pore 67, which are the fuel control means, and also on the biasing force of the first elastic member 66*c* which sets the second set pressure Pm, so that by adjusting these items to an optimum value, the gradient F of the dropping pressure is set to as low a value as possible.

INDUSTRIAL APPLICABILITY

As described above, the fuel supply apparatus according to the present invention is appropriate as an apparatus for keeping the pressure of the fuel delivered under pressure to an injector from dropping, even when the returning flow volume, which is returned from the fuel pressure regulator to the fuel tank, drops.

What is claimed is:

1. A fuel supply apparatus comprising:

a cover (3) fitted to an opening (2*a*) of a fuel tank (2), and on which a discharge pipe (7) is disposed;

a fuel pump (4) for delivering under pressure fuel from said fuel tank (2) to an injector of an engine via said discharge pipe (7);

a fuel filter (5) for filtering the fuel discharged from said fuel pump (4); and a fuel pressure regulator (60) for regulating the pressure of the fuel discharged from said fuel pump (4) to a predetermined pressure (Pi);

wherein said fuel pressure regulator (60) includes:

a first chamber (62), formed in a case (61), into which fuel discharged from said fuel pump (4) flows, and a second chamber (63), into which the fuel flows via the first chamber (62);

a fuel control means (64) disposed between said first chamber (62) and said second chamber (63), for limiting fuel flowing from said first chamber (62) into said second chamber (63);

a pilot valve unit (65) having a passageway for opening to discharge fuel into said fuel tank (2), when the fuel pressure in said second chamber (63) is more than a first set pressure (Pp); and a main valve unit (66) for opening and closing to discharge fuel into said fuel tank (2), when the fuel pressure in said first chamber (62) is equal to a second set pressure (Pm) between the first set pressure (Pp) and the predetermined pressure (Pi).

2. A fuel supply apparatus according to claim 1, the main valve unit (66) comprising:

a first valve (66*b*) for opening and closing a first communicating hole (66*a*) connecting said first chamber (62) with said fuel tank (2); and a first elastic member (66*c*) for pressing on said first valve (66*b*); wherein said first valve (66*b*) is held such that it can slide on a slide portion (61*a*) of said case (61); and said fuel control means is realized by a gap (64) formed between said slide portion (61*a*) and said first valve (66*b*).

3. A fuel supply apparatus according to claim 1, further comprising a diffusing member (68) installed for dispersal of fuel being returned from said main valve unit (66) to the fuel tank (2).

4. A fuel supply apparatus according to claim 2, further comprising a pore (67) situated in said first valve (66*b*).

5. A fuel pressure regulator for regulating, to a predetermined pressure (Pi) the pressure of fuel discharged from a fuel pump (4) comprising:

a first chamber (62) formed in a case (61), into which fuel discharged from said fuel pump (4) flows, and a second chamber (63), into which the fuel flows via said first chamber (62);

a fuel control means (64) disposed between said first chamber (62) and said second chamber (63), for limiting fuel flowing from said first chamber (62) into said second chamber (63);

a first communicating hole (66*a*) for connecting said first chamber (62) with the exterior of said case (61);

a second communicating hole (65*a*) for connecting said second chamber (63) with the exterior of said case (61);

a pilot valve unit (65) for opening to discharge through the second communicating hole (65*a*) fuel to outside of said case (61), when the fuel pressure in said second chamber (63) is more than a first set pressure (Pp); and a main valve unit (66) for opening to discharge through the first communicating hole (66*a*) fuel to the exterior of said case (61), when the fuel pressure of said first chamber (62) is equal to a second set pressure (Pm) between the first set pressure (Pp) and the predetermined pressure (Pi).

6. A fuel pressure regulator according to claim 5, further comprising a diffusing member (68) installed for dispersal of fuel discharged from said main valve unit (66) to the exterior of said case (61).

* * * * *